US008397811B2

(12) United States Patent
Reid

(10) Patent No.: US 8,397,811 B2
(45) **Date of Patent: *Mar. 19, 2013**

(54) GAS BOOST PUMP AND CROSSOVER IN INVERTED SHROUD

(75) Inventor: Leslie Claud Reid, Coweta, OK (US)

(73) Assignee: Baker Hughes Incorporated, Houston, TX (US)

( * ) Notice: Subject to any disclaimer, the term of this patent is extended or adjusted under 35 U.S.C. 154(b) by 478 days.

This patent is subject to a terminal disclaimer.

(21) Appl. No.: 12/683,339

(22) Filed: Jan. 6, 2010

(65) Prior Publication Data

US 2011/0162832 A1 Jul. 7, 2011

(51) Int. Cl.
*E21B 43/38* (2006.01)

(52) U.S. Cl. ..... 166/265; 166/105.5; 166/68

(58) Field of Classification Search ..... 166/105.5, 166/105.6, 106, 68, 265; 417/423.5, 423.3
See application file for complete search history.

(56) References Cited

U.S. PATENT DOCUMENTS

| | | | | |
|---|---|---|---|---|
| 2,345,710 | A * | 4/1944 | Lybyer | 166/105.1 |
| 4,275,790 | A * | 6/1981 | Abercrombie | 166/372 |
| 4,676,308 | A * | 6/1987 | Chow et al. | 166/369 |
| 6,113,675 | A * | 9/2000 | Branstetter | 95/261 |
| 6,179,056 | B1 * | 1/2001 | Smith | 166/313 |
| 6,209,641 | B1 * | 4/2001 | Stevenson | 166/266 |
| 6,260,627 | B1 * | 7/2001 | Rivas | 166/369 |
| 6,325,143 | B1 * | 12/2001 | Scarsdale | 166/54.1 |
| 6,494,258 | B1 * | 12/2002 | Weingarten | 166/265 |
| 6,651,740 | B2 * | 11/2003 | Kobylinski et al. | 166/265 |
| 6,691,782 | B2 * | 2/2004 | Vandevier | 166/265 |
| 6,705,403 | B2 * | 3/2004 | Podio et al. | 166/370 |
| 6,755,250 | B2 * | 6/2004 | Hall et al. | 166/265 |
| 6,932,160 | B2 * | 8/2005 | Murray et al. | 166/369 |
| 6,945,762 | B2 * | 9/2005 | Williams | 417/546 |
| 6,964,299 | B2 * | 11/2005 | Scarsdale | 166/105 |
| 7,377,313 | B2 * | 5/2008 | Brown et al. | 166/105.5 |
| 7,377,314 | B2 * | 5/2008 | Gonzalez | 166/105.5 |
| 7,445,429 | B2 * | 11/2008 | Wilson et al. | 415/199.5 |
| 7,635,030 | B2 * | 12/2009 | Knight et al. | 166/369 |
| 7,708,059 | B2 * | 5/2010 | Shaw | 166/105.5 |
| 8,028,753 | B2 * | 10/2011 | Shaw et al. | 166/369 |
| 8,141,625 | B2 * | 3/2012 | Reid | 166/105.5 |
| 8,196,657 | B2 * | 6/2012 | Kennedy | 166/265 |
| 2003/0141056 | A1 * | 7/2003 | Vandevier | 166/265 |
| 2004/0031608 | A1 * | 2/2004 | Hall et al. | 166/265 |
| 2005/0173107 | A1 * | 8/2005 | Heilmann et al. | 166/68 |
| 2009/0032264 | A1 * | 2/2009 | Shepler | 166/370 |
| 2009/0065202 | A1 * | 3/2009 | Brown et al. | 166/267 |
| 2009/0151928 | A1 * | 6/2009 | Lawson | 166/105.5 |
| 2009/0159262 | A1 | 6/2009 | Gay et al. | |
| 2009/0211755 | A1 | 8/2009 | Dyer et al. | |
| 2009/0272538 | A1 * | 11/2009 | Kennedy | 166/369 |
| 2010/0319926 | A1 * | 12/2010 | Reid | 166/372 |

* cited by examiner

*Primary Examiner* — William P Neuder
*Assistant Examiner* — Blake Michener
(74) *Attorney, Agent, or Firm* — Bracewell & Giuliani LLP

(57) ABSTRACT

An above-motor mixed flow booster pump combined with a fluid crossover that directs up into the inside of an inverted shroud to allow enhanced gas separation. A gas and liquid separator is used to enhance separation. The system provides gas handling capability for high flow or low flow gas well dewatering applications, including vertical wells, horizontal wells, slant wells. The boost pump allows the moving of a mixed flow upwards to the top of an inverted shroud in wells lacking the required pressure.

15 Claims, 3 Drawing Sheets

Fig. 2B
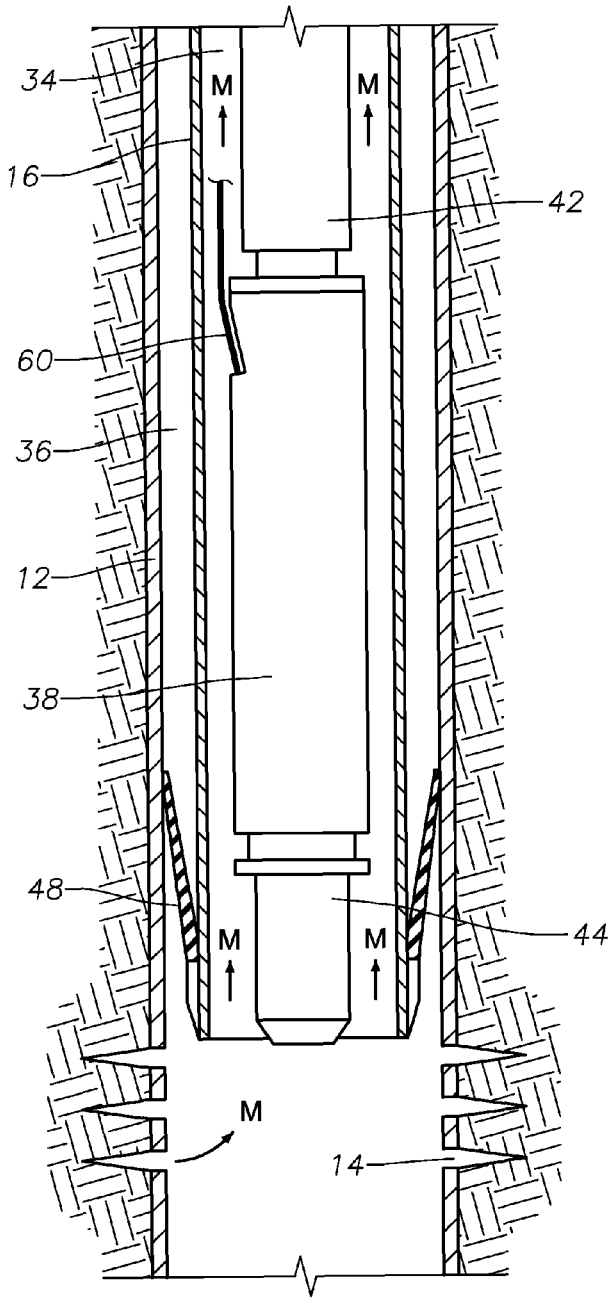
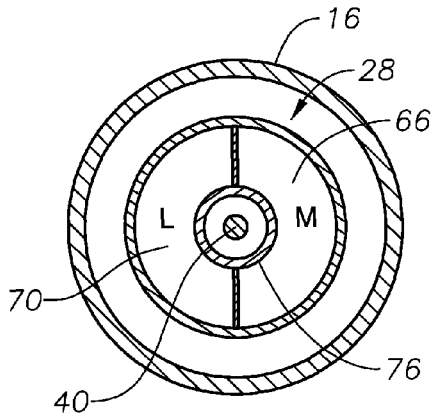
Fig. 3

GAS BOOST PUMP AND CROSSOVER IN INVERTED SHROUD

FIELD OF THE INVENTION

This invention relates in general to shrouds used in the separation of gas from liquid, and in particular to using a boost pump with a crossover in wells lacking the pressure to move a mixed flow upwards to the top of an inverted shroud.

BACKGROUND OF THE INVENTION

In gas well dewatering applications it is desired to draw the well down to the lowest reservoir pressure as possible in order to maximize gas production. To prevent lift pumps from gas locking, inverted shrouds are used as a way to separate gas from liquid. Inverted shrouds are typically long and in effect, raise the intake of the pump to the top of the shroud. Further pressure increase occurs due to the frictional drag in the annulus between the shroud and the casing.

It is becoming increasingly desirable to dewater a zone by placing the ESP pump in a horizontal well-bore. In horizontal gas wells, however, the gas bubble buoyancy forces are not acting in the optimum direction for moving gas out of the well bore. In these wells much of the gas production goes up the casing/tubing annulus. Because a significant length of well-bore is horizontal, it is very difficult to keep the necessary fluid level over the pump. Thus, static liquid in a horizontal gas well may choke the gas flow.

A technique is thus needed to boost the gas and liquid to the vertical or high angle to allow the buoyancy forces to separate the gas from liquid.

SUMMARY OF THE INVENTION

In an embodiment of the present invention, a dewatering apparatus with enhanced gas separation is illustrated, with a mixed flow booster pump located above a motor and within a shroud located in a cased well. The shroud may be inverted and can be combined with a fluid crossover assembly that may have mixed flow and liquid chambers that are isolated from each other. The crossover assembly may be connected to the discharge of the booster pump at an upstream end and at a downstream end to an intake of a lift pump. The crossover assembly can receive mixed flow from the well and has an outlet that directs the mixed flow up into the inside of the inverted shroud into an inner annulus formed by the outer diameter of the lift pump and inner diameter of the shroud where separated gas can escape through an open end on the downstream side of the shroud. The booster pump can be used in wells lacking the required pressure to move the mixed flow upwards through the shroud. Thus, the booster pump only needs to provide enough head to move the mixed flow up to the top of the inverted shroud. To further enhance gas separation, the shroud may be perforated near the downstream end and have a vortex inducer near the perforated section that induces fluid rotation such that the high percentage liquid, such as water, is flung outward, through the perforations and into an outer annulus defined by the shroud's outer diameter and casing inner diameter. High percentage refers to the high percentage of liquid versus gas in the liquid flow.

Once the high percentage liquid is in the outer annulus, gravity causes the liquid to fall downwards and enters a port in the fluid crossover. The port is in communication with the intake of the lift pump, allowing the lift pump to pump the liquid up through a production tubing string extending through the shroud and leading to a wellhead. A seal or packer may be located in the inner annulus above and below the fluid crossover and another seal could be located in the outer annulus between the upstream end of the shroud and the casing.

The invention is simple and provides enhanced gas separation and increased gas handling capability for high flow or low flow gas well dewatering applications, including vertical wells, horizontal wells, slant wells. This invention further advantageously allows for pumping mixed flow gas wells such as those that require dewatering. This invention could help gas dewatering operators have much greater production and in effect lower the overall cost of production.

BRIEF DESCRIPTION OF THE DRAWINGS

FIG. 3 is cross sectional view of the crossover assembly of FIG. 1, taken along the line 3-3 of FIG. 2, in accordance with the invention.

DETAILED DESCRIPTION OF THE INVENTION

Figure 1A:
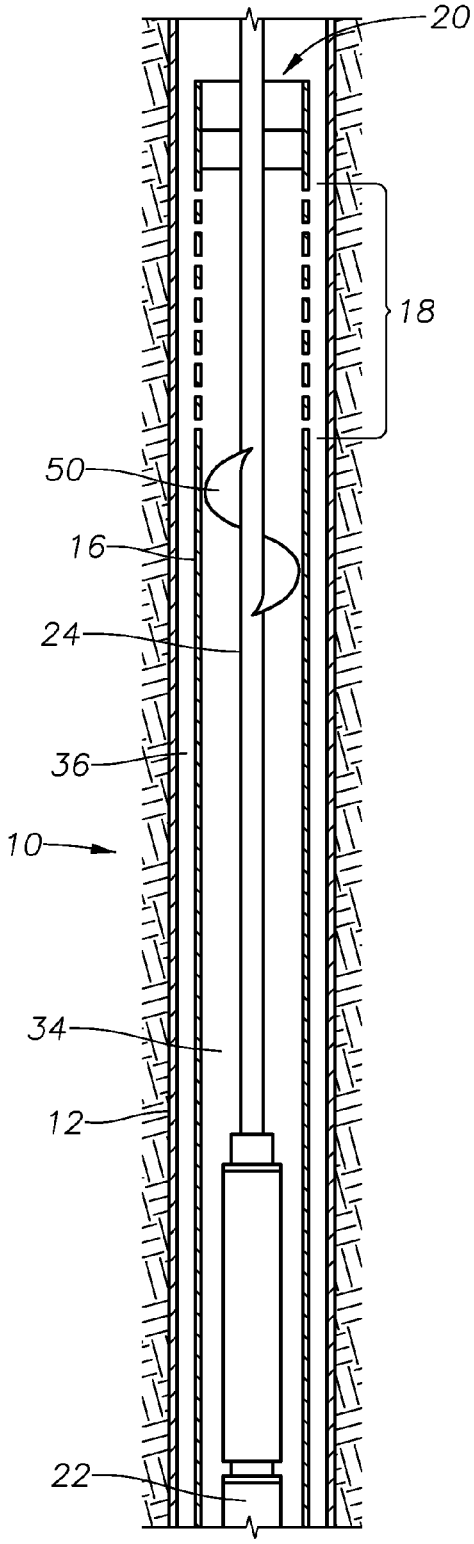
FIG. 1 is a sectional view of a well installation in accordance with the invention.
Figure 1B:
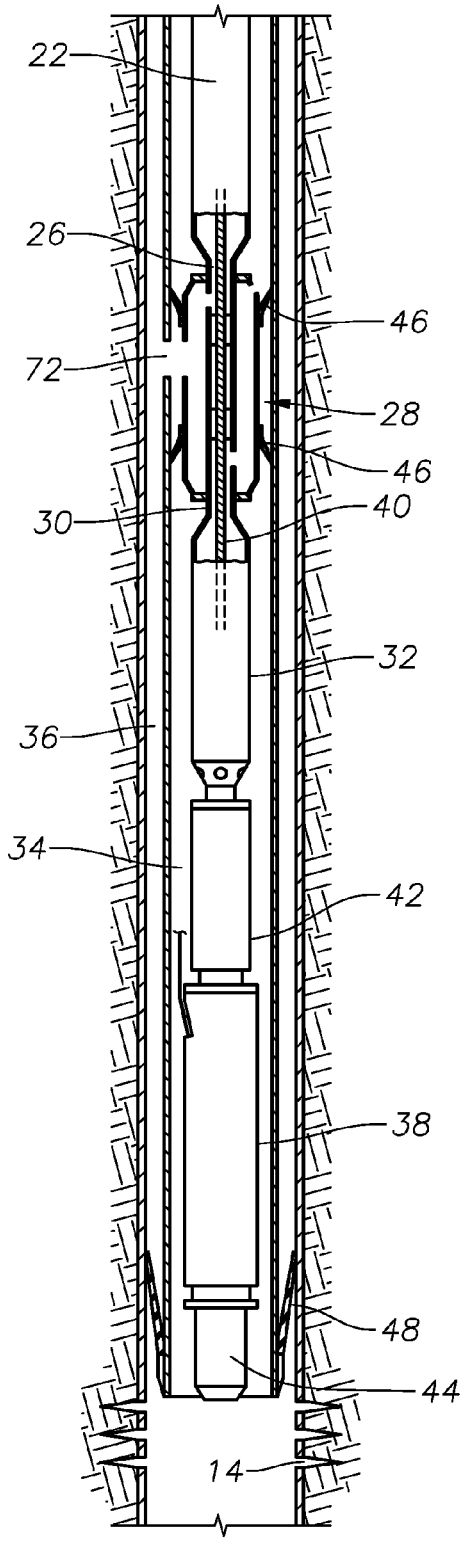

Referring to FIG. 1, an embodiment of a dewatering apparatus 10 is shown located within the casing 12 of a well having perforations 14 to allow fluid flow from the formation. The dewatering, apparatus 10 includes an inverted shroud 16 that may have a separating device or perforated section 18 approximately located at an open top end 20. A lift pump 22 for pumping fluid to the surface via a production tubing string 24 has an intake 26 that may be connected to a downstream end of a crossover assembly 28. The lift pump 22 could comprise multiple stages. Intake 26 of lift pump 22 is located downstream from perforated section 18, meaning that liquid from the well first passes through perforated section 18 before reaching pump intake 26. A discharge end 30 of a booster pump 32 connects to an upstream end of the crossover assembly 28 to pump a mixed fluid flow of liquid and gas up an inner annulus 34 that is defined by the outer diameter of the lift pump 22 and the inner diameter of the shroud 16. The upstream, end of crossover assembly 28 means that fluid flowing in inner annulus 34 flows through booster pump 32 before reaching crossover assembly 28. Fluid flowing into lift pump intake 26 first flows through booster pump 32 and crossover assembly 28. An outer annulus 36 is defined by outer diameter of the shroud 16 and the inner diameter of the casing 12. The booster pump 32 may have stages for gas handling and impellers suitable for gas handling.

Both the lift pump 22 and the booster pump 32 are located above a motor 38 in this example, with the motor 38 having a power cable 60 (FIG. 2) that extends to the surface. A shaft 40 is connected to the motor 38 and extends through a seal section 42, through the booster pump 32, through the crossover assembly 28 and into the lift pump 22. This configuration of the shaft 40 allows the motor 40 to drive both the lift pump 22 and the booster pump 32. Additionally, a sensor 44 may be located on the upstream side of the motor.

Inner annulus seals 46 may be located upstream and downstream of the crossover assembly 28 to prevent recirculation of fluid. Further, an outer annulus seal 48 can be located at the upstream end of the shroud 16 between the shroud 16 and the casing 12 to create a seal between the mixed flow entering from the formation and the separated liquid in the outer annulus 36.

Further, a vortex inducer 50 may be attached to the production tubing 24 at a point below the perforated section 18 of the shroud 16 to further enhance gas separation. Vortex inducer 50 is located near the downstream end of shroud 16. which is the end where fluid flowing in annulus 34 is discharged. The apertures in perforated screen 18 are downstream from vortex inducer 50, thus the fluid first flows through vortex inducer 50 before reaching perforated screen 18. The vortex inducer 50 induces the mixed flow in the inner annulus 34 to rotate, thereby causing the heavier liquid to move outward towards the perforations in the perforated section 18 and allowing the lighter gas to flow upwards through the open top end 20 of the shroud 16. The vortex inducer 50 may comprise helical blades attached to a body that may be clamped onto the production tubing.

Figure 2A:
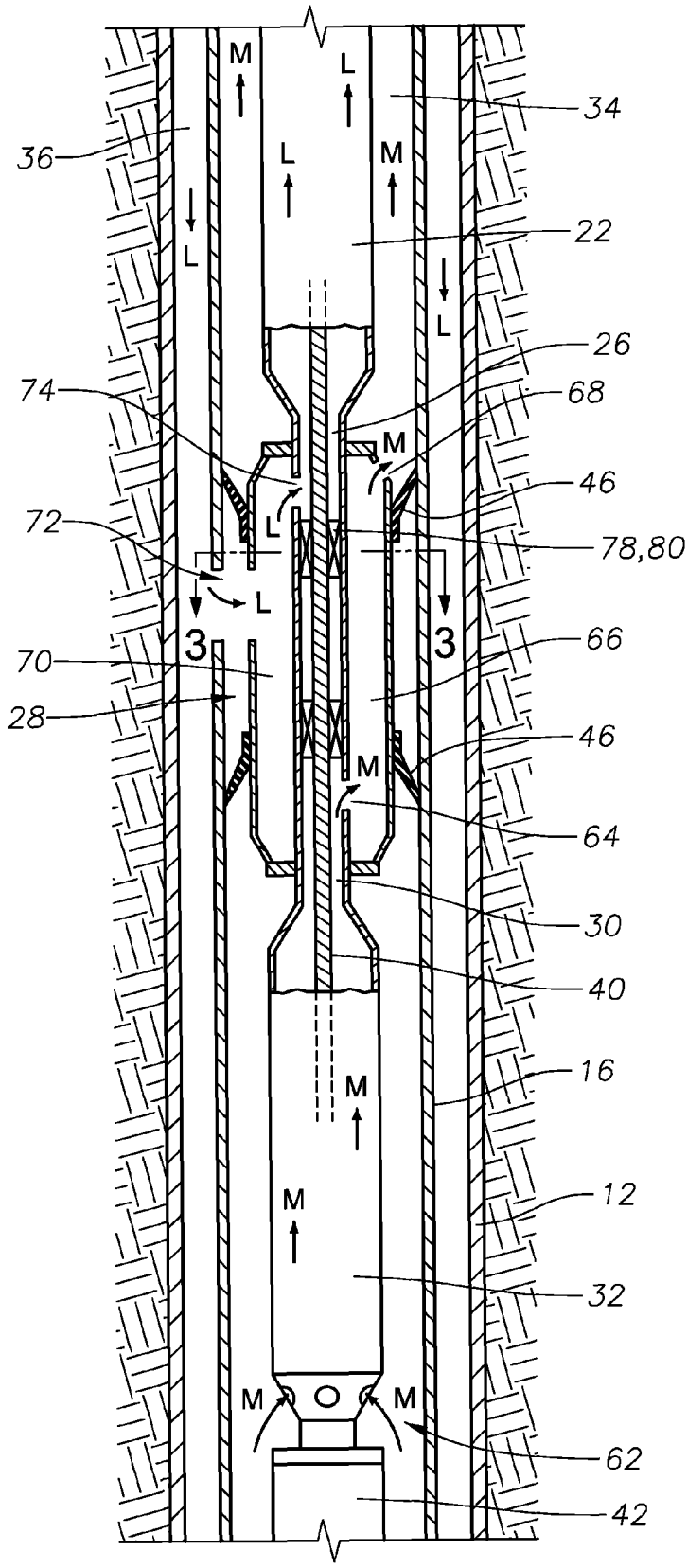
FIG. 2 is an enlarged sectional view of the well installation of FIG. 1 showing the details of a crossover assembly in accordance with the invention.

Referring to FIG. 2, an enlarged and more detailed view of the crossover assembly 28 and of the booster pump 32 is shown. The booster pump 32 has an intake 62 for receiving the mixed flow from the well. The discharge end 30 of the booster pump 32 is in communication with a mixed flow inlet 64 that opens up into a mixed flow chamber 66 within the crossover assembly 28. The mixed flow chamber 66 has an outlet 68 in communication with the inner annulus 34. The crossover assembly 28 further comprises a liquid chamber 70 that may be isolated from the mixed flow chamber 66.

An opening 72 in the inverted shroud 16 communicates the outer annulus 36 with the liquid chamber 70 to allow high percentage liquid to flow into the liquid chamber 70 of the crossover assembly 28. As mentioned above, high percentage liquid refers to the high percentage of liquid versus gas in the liquid flow in the outer annulus 36. The liquid flow chamber 70 has an outlet 74 in communication with the intake 26 of the lift pump 22. As illustrated in the cross-sectional view of FIG. 3, a central shaft passage 76 is formed in the crossover assembly 28 to allow the shaft 40 to pass through the crossover assembly to drive the lift pump 22. The passage 76 is isolated from both the mixed flow chamber 66 and the liquid flow chamber 70. Radial support bearings 78 may be used within the passage 76 to support the shaft 40 and seals 80 between the shaft 40 and the passage 76 prevent recirculation through the shaft passage 40.

In operation, referring to FIGS. 1 and 2, the mixed flow, identified by arrows and an "M," containing liquid and gas enters the well casing 12 via the perforations 14 below the dewatering apparatus 10 in this example. The mixed flow circulates upward within the shroud 16 past the motor 38 and seal section 42 and into the booster pump intake 62. The discharge end 30 of the booster pump 32 discharges into the mixed flow chamber 66 of the crossover assembly 28 via mixed flow inlet 64. The mixed flow then exits the crossover assembly 28 via mixed flow outlet 68 and into the inner annulus 34.

Once in the inner annulus 34, the head generated by the booster pump 32 is sufficient to lift the mixed flow downstream past the exterior of the lift pump 22, production tubing 26, and to the top of the shroud 16. If the vortex inducer 50 is located within the shroud 16 at approximately the top end of the shroud 16, the mixed flow will be induced into rotational motion, causing the heavier liquid in the mixed flow to be slung outwards against the inside of the shroud 16 and concentrating the lighter gas towards the center of the shroud 16 where the gas can continue downstream to the surface via the top open end 20. If the perforated section 18 is included at the top end of the shroud 16, the heavier liquid slung outwards will move through the perforations in the perforated section 18 and into the outer annulus 36. The liquid flow in the outer annulus is a high percentage liquid having a high percentage of liquid versus gas. The liquid flow is identified with arrows and an "L" and moves upstream or downward within the outer annulus 36 under gravitational force. In this embodiment, the liquid flow then enters the liquid flow chamber 70 of the crossover assembly 28 via the passage 72 in the shroud 16. Once in the liquid flow chamber 70, the liquid flow flows into the lift pump intake 26 via an outlet 74 in communication with the intake 26 of the lift pump 22. The lift pump 22 then discharges the liquid into the production tubing string 24 where it is pumped up to the surface.

Although shown as a separate component in the embodiment described above, the crossover assembly 28 may be integral to the shroud 16, with the chambers 66, 70 formed into the shroud 16.

While the invention has been shown in only a few of its forms, it should be apparent to those skilled in the art that it is not so limited and is susceptible to various changes and modifications without departing from the scope of the invention.

What is claimed is:

1. A well dewatering apparatus comprising:

a shroud adapted for placement within a cased well wherein an outer diameter of the shroud and a casing inner diameter form an outer annulus between the shroud and the casing;

a lift pump located within the shroud, defining an inner annulus between an outer diameter of the lift pump and an inner diameter of the shroud, the lift pump having an intake in fluid communication with the outer annulus and having an outlet in fluid communication with a tubing string;

a boost pump located within the shroud upstream of the lift pump and having an intake in fluid communication with an interior of the shroud for receiving a mixed flow of gas and liquid flowing into the shroud, the boost pump having an outlet in fluid communication with the inner annulus; and a separating device upstream of the lift pump and downstream of the boost pump, the separating device receiving the mixed flow from the inner annulus, separating liquid from the mixed flow, and directing a separated liquid flow into the outer annulus, the separating device directing gas separated from the mixed flow into the casing for flowing to the wellhead.

2. The apparatus of claim 1, further comprising a crossover assembly having a mixed flow chamber for receiving the mixed flow, the crossover assembly having an inlet port in communication with the outlet of the booster pump and an outlet port in communication with the inner annulus; the crossover assembly having a separated liquid flow chamber with an inlet port in communication with the outer annulus and an outlet port in communication with the intake of the lift pump.

3. The apparatus of claim 2, wherein the mixed flow chamber and separated liquid flow chamber are isolated from each other.

4. The apparatus of claim 1, further comprising an inner annulus seal upstream of the lift pump intake and an inner annulus seal downstream of the lift pump intake.

5. The apparatus of claim 1, further comprising an outer annulus seal at the upstream end of the outer annulus between the shroud and the casing.

6. The apparatus of claim 1, further comprising a motor located below both the boost pump and the lift pump, the motor driving both the boost pump and lift pump.

7. The apparatus of claim 1, wherein the separating device comprises an open upper end of the shroud that causes the mixed flow to reverse direction.

8. The apparatus of claim 1, wherein the separating device comprises a vortex inducer at the downstream end of the shroud, the shroud having apertures downstream from the vortex inducer.

9. A well comprising:

a casing extending downward into the well;

a shroud adapted for placement within the casing in the well wherein an outer diameter of the shroud and a casing inner diameter form an outer annulus between the shroud and the casing;

a lift pump located within the shroud, defining an inner annulus between an outer diameter of the lift pump and an inner diameter of the shroud, the lift pump having an intake in fluid communication with the outer annulus and having an outlet;

a boost pump located within the shroud below the lift pump, the boost pump having an intake in fluid communication with an interior of the shroud for receiving a mixed flow of gas and liquid flowing into the shroud, the boost pump having an outlet in fluid communication with the inner annulus;

a crossover assembly having a mixed flow chamber for receiving the mixed flow, the crossover assembly having an inlet port in communication with the outlet of the booster pump and an outlet port in communication with the inner annulus; the crossover assembly having a separated liquid flow chamber with an inlet port in communication with the outer annulus and an outlet port in communication with the intake of the lift pump;

a separating device upstream of the lift pump and downstream of the boost pump comprising an opening at an upper end of the shroud, the separating device receiving the mixed flow from the inner annulus, separating liquid from the mixed flow, and directing a separated liquid flow into the outer annulus, the separating device directing gas separated from the mixed flow into the casing for flowing to the wellhead;

a production tubing string, the string in fluid communication with the outlet of the lift pump to receive and direct liquid from the lift pump upwards to the surface;

an inner annulus seal above the crossover assembly and an inner annulus seal below the crossover assembly; and an outer annulus seal at the lower end of the outer annulus between the shroud and the casing.

10. The apparatus of claim 9, further comprising a motor located below both the boost pump and the lift pump, the motor driving both the boost pump and lift pump.

11. The apparatus of claim 9, wherein the mixed flow chamber and separated liquid flow chamber of the crossover assembly are isolated from each other.

12. The apparatus of claim 9, wherein the separating device comprises a vortex inducer at the downstream end of the shroud, the shroud having apertures downstream from the vortex inducer.

13. A method for dewatering a well comprising:

installing a shroud within a cased well wherein an outer diameter of the shroud and a casing inner diameter form an outer annulus between the shroud and the casing;

locating a lift pump within the shroud and defining an inner annulus between an outer diameter of the lift pump and an inner diameter of the shroud, the lift pump having an intake in fluid communication with the outer annulus and having an outlet adapted to he connected to a tubing string extending through the shroud and leading to a wellhead;

locating a boost pump within the shroud upstream of the lift pump, the boost pump having an intake in fluid communication with an interior of the shroud for receiving a mixed flow of gas and liquid flowing into the shroud, the boost pump having an outlet in fluid communication with the inner annulus;

installing a separating device upstream of the lift pump and downstream of the boost pump for receiving the mixed flow from the inner annulus;

separating liquid from the mixed flow;

directing a separated liquid flow into the outer annulus for gravitating in an upstream direction to the lift pump inlet; and directing gas separated from the mixed flow into the casing for flowing to the wellhead.

14. The method of claim 13, further comprising isolating the mixed flow from the separated liquid flow from each other.

15. The method of claim 13, further comprising inducing a vortex in the mixed flow within the shroud and at the downstream end of the shroud.

* * * * *